US005728478A

United States Patent [19]

Wilson et al.

[11] Patent Number: 5,728,478

[45] Date of Patent: Mar. 17, 1998

[54] DISPLAY MATTRESSES AND BOX SPRINGS

[76] Inventors: Kevin W. Wilson, 72 Springer Ct., Hockessin, Del. 19707; Julie M. Robino, 22 Carriage Path, Chadds Ford, Pa. 19317

[21] Appl. No.: 582,642

[22] Filed: Jan. 4, 1996

[51] Int. Cl.[6] ..... B29B 7/00; A47C 19/00; B31F 1/00

[52] U.S. Cl. ..... 428/542.8; 5/400; 5/924; 40/539; 40/605; 206/736; 206/45.21; 206/784; 220/416; 493/405; 428/34.2

[58] Field of Search ..... 5/400, 924; 40/539, 40/605; 446/482; 206/736, 45.21, 784; 220/416; 428/542.8, 34.2, 182; 493/405, 463

[56] References Cited

U.S. PATENT DOCUMENTS

| | | | |
|---|---|---|---|
| 2,335,070 | 11/1943 | Luhrs | 41/11 |
| 3,761,974 | 10/1973 | Kuss | 5/348 WB |
| 3,913,154 | 10/1975 | Sweeney | 5/186 R |
| 4,919,982 | 4/1990 | Hayes | 428/34.2 |
| 4,965,106 | 10/1990 | Dechristopher | 428/34.2 |
| 5,231,714 | 8/1993 | Mossbeck | 5/400 |

*Primary Examiner*—Donald Loney
*Attorney, Agent, or Firm*—Synnestvedt & Lechner

[57] ABSTRACT

Display beds for use in bedroom furniture displays are constructed of a series of paperboard units which are combined to form single, full, queen or king size mattresses and boxsprings. The units are lightweight and compact and are internally reinforced to enhance crush resistance. The units are preferably constructed from corrugated cardboard blanks which are folded into a box-like shape and combined to form a given size bed. The cardboard blanks and methods of constructing the display beds are disclosed and claimed.

20 Claims, 7 Drawing Sheets

DISPLAY MATTRESSES AND BOX SPRINGS

BACKGROUND OF THE INVENTION

This invention relates to display beds used in showroom displays, model homes, furniture stores, travelling home shows and other situations where it is desirable to display a bedding arrangement but avoid the weight, bulk and expense of actual mattresses and box springs.

Builders, architects and real estate agents often need to demonstrate to a client or homebuyer what the interior of a house or other structure will look like with furnished bedrooms. However, the cost of obtaining and transporting real furniture for every aspect of a display setting is often unjustifiably expensive. Furthermore, use of real furniture requires hiring moving crews to set up and arrange the furniture. As an example, to set up a display of a king or queen size bed, two or more people are needed for delivery and installation of the boxspring and mattress. In addition, in situations where a large number of beds are to be used, such as in a tract of model homes, considerable expense is involved in buying the required mattresses and box springs for the bedroom displays.

Accordingly, there is a demand for inexpensive alternatives to the use of actual mattresses and box springs in a display setting. For a display bed to be suitable for widespread use, it must satisfy a number of criteria. The display beds must be constructed of lightweight material so that one person can easily assemble or dismantle a display setting. Although constructed of lightweight materials, the beds must be sufficiently strong to support the weight of an adult. The display bed must also be compact in its unassembled state to minimize shipping costs and to facilitate storage when not in use. The display bed must additionally be durable enough to survive repeated cycles of assembly and disassembly.

In addition to uses in display settings, it is contemplated that the display beds of the present invention may be used in times of emergency as temporary beds. Blankets or foam may be placed upon the top of the display bed units and the units may be used in facilities such as, for example, Red Cross shelters and the like in times of emergency. Alternatively, long-term shelter facilities which are unable to afford the expense of real mattresses and box springs may use the display beds in temporary overcrowding situations.

It is also anticipated that the display beds of the present invention may serve as temporary beds for people with back problems or other medical requirements which make sleeping on and/or getting out of a bed painful because normal mattresses do not provide sufficient support. People in need of a stiff sleeping surface will often insert a plywood board under their mattress to alleviate discomfort due to various back ailments. However, the display beds of the present invention provide an alternative to the use of plywood boards and the like and can be conveniently stored either folded flat or in constructed form under a bed. At the onset of pain or discomfort, a person may utilize the display bed as a temporary sleeping surface which provides sufficient support and rigidity.

The present invention satisfies the above requirements for a display bed by utilizing box-like units which are combined to form a mattress or box spring of a given size. The units are constructed of paperboard material, and vary in size depending on the size of the bed they are used to simulate. The units may be used to simulate a mattress alone or both a boxspring and a mattress.

SUMMARY AND OBJECTS OF THE INVENTION

The present invention is directed to display bed units used to simulate actual mattresses and box springs. The units are shipped in a flat shape for construction at the site of the display. Internal reinforcements are used to increase the strength of the beds and the units preferably include mitered corners to simulate the rounded corners of an actual mattress or box spring. If desired, the mitered corners of the units may be replaced by curved corners to even more accurately represent the shape of an actual mattress or box spring.

The display bed units are constructed of paperboard materials. Paperboard, as the term is used herein, encompasses corrugated board products, foamboard, and corrugated plastic. In preferred embodiments, corrugated board, preferably corrugated cardboard, is used to construct the units. Corrugated cardboard, as the term is used herein, refers to a variety of corrugated cardboard products, including, for example, single, double and triple wall corrugated cardboard. Depending on the requirements of the user, the display beds of the present invention may be constructed of these different corrugated cardboard types and, if desired, the cardboard may be treated for water- and mildew-resistance by applying an appropriate coating onto the cardboard, such as, for example, a wax coating. However, in preferred embodiments of the present invention, the corrugated cardboard used in construction of the beds is of the single wall type.

In preferred embodiments, corrugated cardboard blanks are manufactured as a single piece for use in constructing the units. The corrugated cardboard blanks incorporate fold lines which facilitate folding the units into a box-like shape. These fold lines may take a variety of forms, but in general they are formed using conventional manufacturing processes known in the art to provide foldable joints in cardboard products. Accordingly, the units may include score lines which run parallel to the corrugation of the board and score lines which include compression of the corrugation wherein the fold lines are perpendicular to the direction of corrugation of the board.

The units have at least one planar support panel having a first pair of fold lines and a pair of side panels wherein the side panels are contiguous with the planar support panel and the first pair of fold lines define the junction between the planar support panel and the side panels and the first pair of fold lines are parallel to the direction of corrugation of the board blank. The planar support panel also includes a pair of end flaps which are contiguous with the planar support panel and a second set of fold lines which define the junction between the planar support panel and the end flaps. The planar support panel also has at least two adjacent mitered corners. Each of the side panels has one pair of end tabs which are contiguous with the side panels and a third pair of fold lines which define the junction between the end tabs and the side panels, and the third pair of fold lines are disposed substantially parallel to the first pair of fold lines. The side panels have a pair of mitered corner fold lines which are disposed in a parallel relationship to the third pair of fold lines.

The planar support panel structure described above is present in all of the embodiments of the present invention and the remaining components of the corrugated board blank fall into two general types, depending on whether the blank is to be used for constructing single beds or full, queen or king size beds. For those blanks to be used in constructing single beds, a single connecting panel which is substantially the same size as the planar support panel is provided. For those blanks to be used to construct display bed units for full, queen or king size beds, two connecting panels are provided that, when combined, are approximately equal in size to the planar support panel.

Accordingly, for those embodiments of the present invention used to construct single size beds, a display bed unit is provided based on the corrugated board blank described hereinabove wherein the display bed unit has a unitary connecting panel which is approximately the same size as the planar support panel and wherein the connecting panel is contiguous with one of the side panels of the planar support panel and the other side panel has a free edge. The unitary connecting panel includes a second pair of end flaps which are contiguous with the connecting panel and a fourth pair of fold lines which define the junction between the connecting panel and the second pair of end flaps. The connecting panels have at least two adjacent mitered corners and a connecting flap opposite the adjacent mitered corners.

In those embodiments of the present invention used to construct full, queen and king size display beds, a display bed unit is provided including a pair of connecting panels, each of which is contiguous with one of the side panels of the planar support panel and wherein the connecting panels have a connecting panel fold line which defines the junction between the side panels and the connecting panels, both of the connecting panels have a pair of connecting panel end flaps which are contiguous with the connecting panels and a pair of connecting panel end flap fold lines which define the junction between the connecting panel and the connecting panel end flaps, wherein at least one of the connecting panels has at least two adjacent mitered corners.

The display bed units of the present invention vary in size depending on the type of mattress size they are intended to simulate. To construct a mattress of the desired size, the units for that size mattress are constructed and combined. In addition to display mattresses, the units may be combined to form a display boxspring of a given size. Accordingly, it is an object of the invention to provide a single-size display bed by combining a plurality of display bed units.

Another object of the invention is to combine a plurality of display bed units to form a full-sized mattress or boxspring.

It is yet another object of the invention is to combine a plurality of display bed units to form a queen-sized mattress or boxspring.

It is a further object of the invention is to combine a plurality of display bed units to form a king-sized mattress or boxspring.

It is yet a further object of the invention to provide corrugated board blanks which may be folded into a box-like unit and combined with other such units to form a display mattress or box spring.

It is still yet another objective of the present invention to provide display bed units which are lightweight yet capable of supporting at least five times their weight without being crushed or irreversibly deformed.

It is still yet another object of the present invention to provide reusable display bed units which may be routinely assembled and disassembled while retaining their strength and appearance.

It is a further object of the present invention to provide corrugated board blanks which lie flat and are of sizes which allow for convenient shipping by common carriers.

It is yet another objective of the invention to provide for display bed units capable of being used as emergency beds for prolonged use by a person in need of a temporary bed unit such as, for example, temporary beds used in emergency shelters and the like.

It is yet another objective of the invention to provide a hard sleeping surface for people suffering from back injuries or problems which make sleeping on and/or getting in and out of regular beds painful. The display beds of the present invention may be folded and stored in a relatively small area, to be used on an as-needed basis. The display bed may be used on a standard bed frame or directly on the floor, but in either instance, elevates the user from the floor surface.

It is yet another object of the present invention to provide a method for constructing a display bed comprising folding into a box-like shape a corrugated board blank display bed unit. The corrugated board blank comprises at least one planar support panel having a first pair of fold lines and a pair of side panels wherein the side panels are contiguous with the planar support panel and the first pair of fold lines define the junction between the planar support panel and the side panels and the first pair of fold lines are parallel to the direction of corrugation of the board blank. The planar support panel includes a pair of end flaps which are contiguous with the planar support panel and a second set of fold lines which define the junction between the planar support panel and the end flaps, the planar support panel having at least two adjacent mitered corners, each of the side panels having one pair of end tabs which are contiguous with the side panels and a third pair of fold lines which define the junction between the end tabs and the side panels. The third pair of fold lines are disposed substantially parallel to the first pair of fold lines, the side panels having a pair of mitered corner fold lines disposed in a parallel relationship to the third pair of fold lines. Two or more of the display bed units are combined to form a display mattress or box spring having the dimensions of a desired bed size.

DETAILED DESCRIPTION OF THE PREFERRED EMBODIMENTS OF THE INVENTION

The display beds of the present invention are inexpensive, lightweight, compact and strong due to the utilization of individual corrugated board, units which are combined to form a desired bed size. The display beds of the present invention are constructed by combining 2 to 4 units together, depending on the size of the display bed. Each unit has four side panels resulting in a minimum of 8 side panels per display bed. Because of the multiple side panels, the display beds are able to support up to about 300 pounds without internal reinforcements. For maximum strength and durability, the display beds of the present invention are additionally strengthened by the use of internal reinforcements which are placed inside of the unit. Use of internal reinforcements more than doubles the strength of the units, enabling the units to support up to about 700 pounds. In a preferred embodiment, additional strength is provided by orientation of the units such that the corrugation runs perpendicularly to the long axis of an adult or child laying upon the units.

In order to maximize the transportability of the units, they have been designed to meet the standard size restrictions of common carriers such as United Parcel Service (UPS) and Federal Express. In general, common carriers which provide overnight service have size limitations of approximately 130 inches of length and girth combined with a maximum length of 108 inches. Because the units, when folded for shipment or storage, are within these size limitations they may be shipped anywhere quickly and inexpensively. The ability of the boxes to fold flat also offers convenient on-site storage once they have arrived at their destination.

The small size of the boxes relative to the size of the simulated bed allows a single person to easily assemble and move even king-size display beds. The portability of the beds is additionally improved by providing pre-cut hand holes in the boxes which allow one to easily move the boxes. The size of the boxes also allows for easy disposal without having to arrange for special pick-up or delivery to a dump site. The boxes also offer the additional advantage of reusability because all that is required to set up the beds is fastening means such as tape or velcro. Accordingly, one can easily disassemble the beds and reassemble them again as desired.

Figure 1:
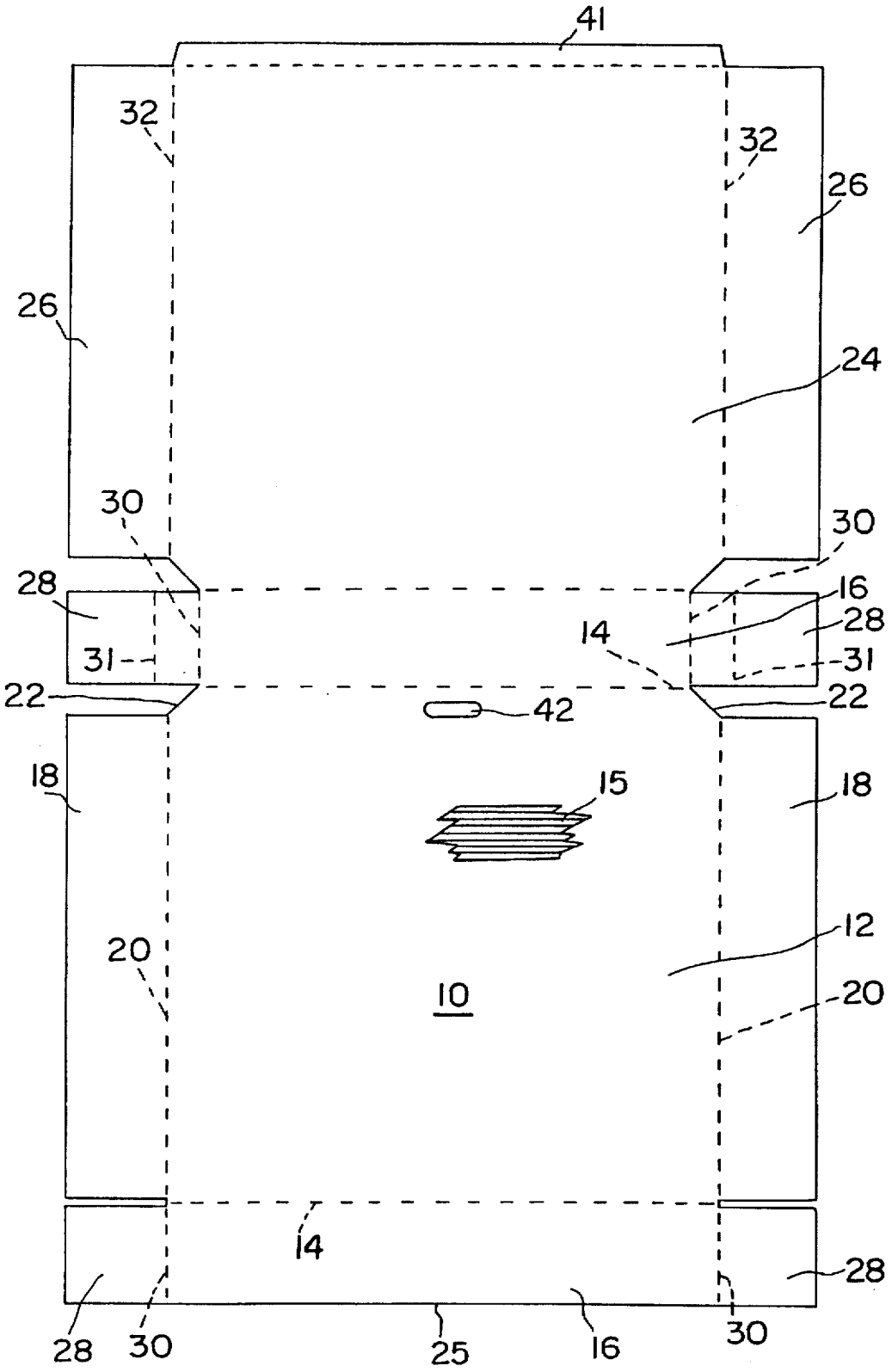
FIG. 1 is an embodiment of the present invention used to construct single size bed mattresses and box springs. Two of the units are combined to construct a single size mattress or box spring.

Referring now to FIG. 1, an embodiment of the present invention used to construct single beds is illustrated. Two such units, 10, are used to construct single beds. A single bed display unit 10 having a planar support panel 12 is provided with a pair of side panels 16 and a first pair of fold lines 14 which define the junction between the planar support panel and the side panels. The planar support panel 12 is intended to serve as the top surface of the display bed, that is, the surface a person would normally sleep upon. In preferred embodiments, the display bed unit is constructed of corrugated cardboard and the first pair of fold lines 14 are parallel to the direction of the corrugation 15 in order to provide maximum structural strength. A pair of end flaps 18 are contiguous with the planar support panel 12 and a second pair of fold lines 20 define the junction between the planar support panel and the end flaps. Preferably, the planar support panel has at least two adjacent mitered corners 22 which provide a closer approximation to the rounded corners of actual mattresses and box springs when the unit is assembled into a single bed display. Once a given unit is combined with other units to form a display bed, some of the side panels 16 will not face outwardly along the bed's perimeter, but will internally face a side panel 16 of the other unit used to build the bed. Each of the side panels 16 has a pair of end tabs 28 and a third pair of fold lines 30 which define the junction between the side panel and its end tabs. The side panel which is adjacent to the mitered corners 22 additionally includes a mitered corner fold line 31 disposed in a parallel relationship to the third pair of fold lines 30 which allows the end tabs 28 to be folded into the shape of a mitered corner. A unitary connecting panel 24 which serves as the bottom surface of the display mattress or box spring is contiguous with one of the side panels 16. In the embodiment intended to be used in the construction of single beds, the unitary connecting panel 24 is approximately the same size as the planar support panel 12 and is contiguous with one of the side panels 16. This connecting panel 24 has a second pair of end flaps 26 which are contiguous with the connecting panel and a fourth pair of fold lines 32 which define the junction between the connecting panel 24 and the second pair of end flaps 26. The connecting panel 24 has at least two adjacent mitered corners 22 and has a connecting flap 41 on the side of the connecting panel 24 which is opposite the mitered corners 22. This connecting flap 41 is fastened to the free edge 25 of the side panel at the opposite end of the unit during assembly of the unit to form a box-like shape. A handhold 42 is positioned close to one of the fold lines 14 and at an equal distance from the mitered corners of the unit.

Figure 2:
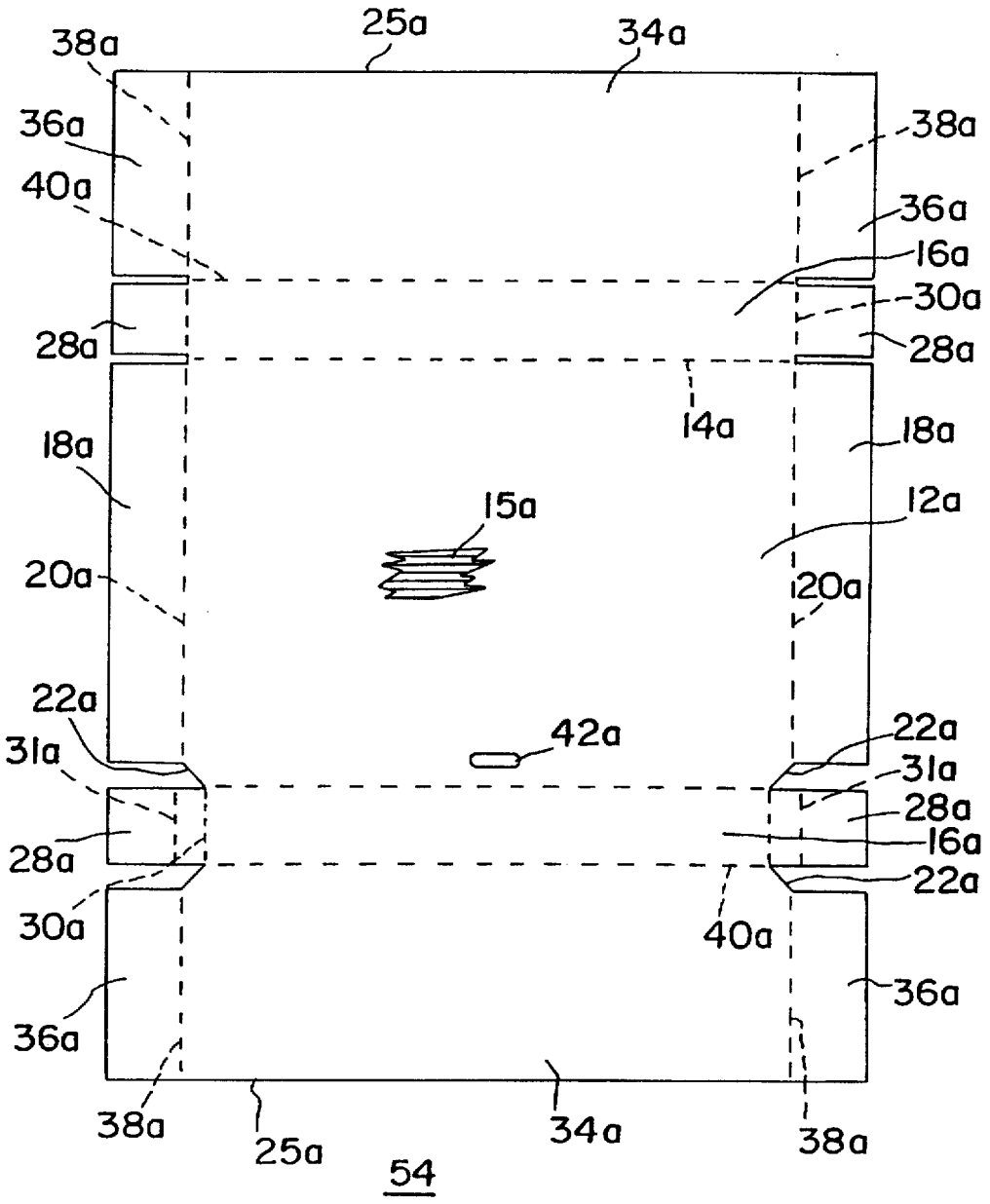
FIG. 2 is an embodiment of the present invention used to construct twin sized bed mattresses and box springs. Two of the units are combined to construct a twin size mattress or box spring.

Referring now to FIG. 2, an embodiment of the present invention used to construct full size beds is illustrated. Two such units 54 are used to construct a full size mattress or box spring. A planar support panel **12*a* is provided with a pair of side panels 16*a* and a first pair of fold lines 14*a* which define the junction between the planar support panel and the side panels. The first pair of fold lines 14*a* are parallel to the direction of the corrugation 15*a* to provide maximum structural strength for the display bed unit. A pair of end flaps 18*a* are contiguous with the planar support panel 12*a* and a second pair of fold lines 20*a* define the junction between the planar support panel and the end flaps 18*a*. In preferred embodiments, the planar support panel has at least two adjacent mitered corners 22*a* and a hand hold 42*a*. Each of the side panels 16*a* has a pair of end tabs 28*a* and a third pair of fold lines 30*a* which define the junction between a given side panel and its end tabs. The side panel which is adjacent to the mitered corners additionally includes a mitered corner fold line 31*a* disposed in a parallel relationship to the third pair of fold lines 30*a*. Contiguous with the side panels 16*a* are a pair of connecting panels 34*a*. Each of the connecting panels has a connecting panel fold line 40*a* which defines the junction between the side panels 16*a* and the connecting panels 34*a*. Both of the connecting panels 34*a* have a pair of connecting panel end flaps 36*a* which are contiguous with the connecting panels and a pair of connecting panel end flap fold lines 38*a* which define the junction between the connecting panel 34*a* and the connecting panel end flaps 36*a*. At least one of the connecting panels 34*a* has a pair of adjacent mitered corners 22*a***.

Figure 3:
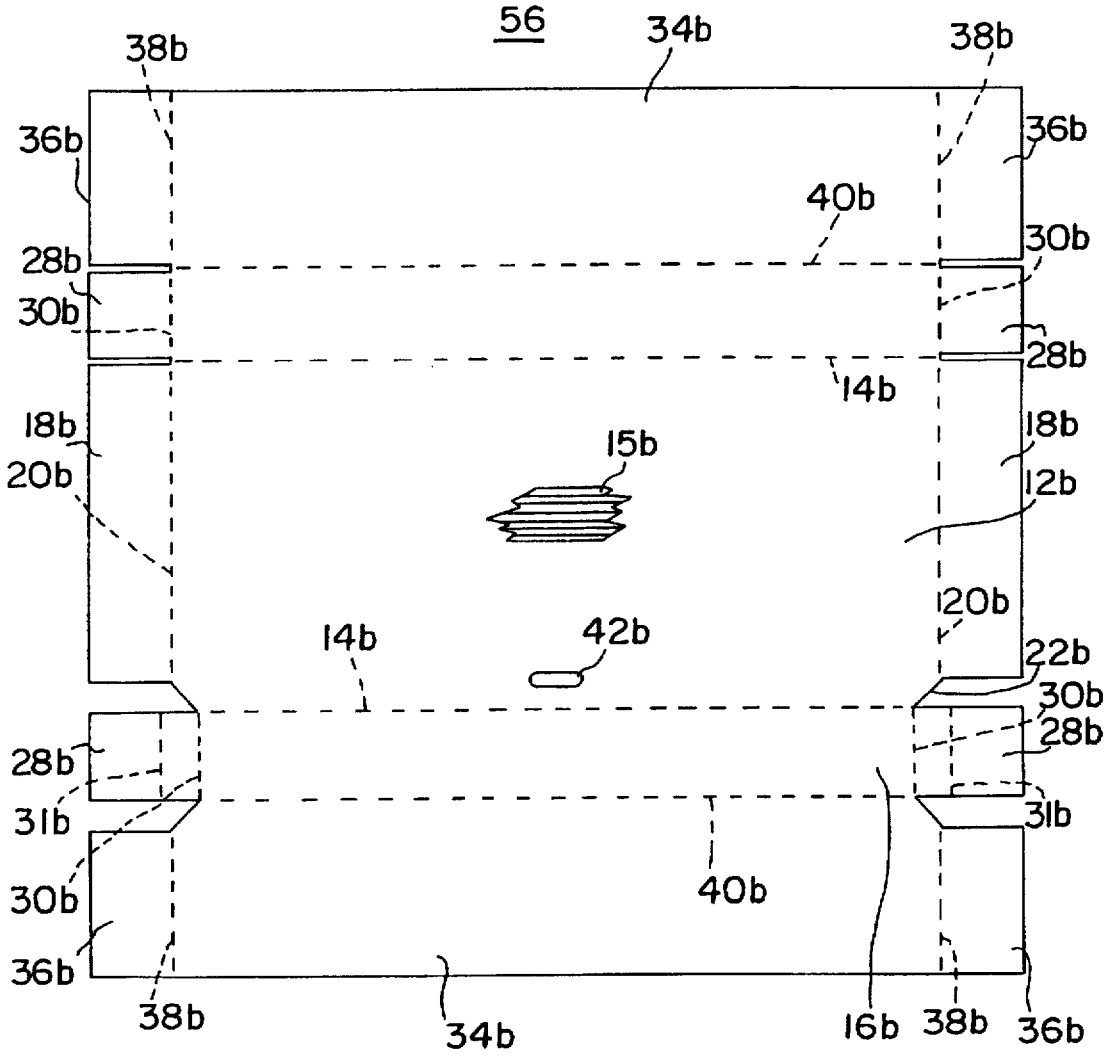
FIG. 3 is an embodiment of the present invention used to construct queen size mattresses and box springs. Three of the units are combined to construct a queen size mattress and box spring.

Referring now to FIG. 3, an embodiment of the present invention used to construct queen size beds, is illustrated. Three of these units 56 are used to construct queen size mattresses and box springs. A planar support panel **12*b* is provided with a pair of side panels 16*b* and a first pair of fold lines 14*b* which define the junction between the planar support panel and the side panels. The first pair of fold lines 14*b* are parallel to the direction of the corrugation 15*b* to provide maximum structural strength for the display bed unit. A pair of end flaps 18*b* are contiguous with the planar support panel 12*b* and a second pair of fold lines 20*b* define the junction between the planar support panel 12*b* and the end flaps 18*b*. The planar support panel has at least two adjacent mitered corners 22*b* and a hand hold 42*b*. Each of the side panels 16*b* has a pair of end tabs 28*b* and a third pair of fold lines 30b which define the junction between a given side panel 16b and its end tabs 28b. The side panel 16b which is adjacent to the mitered corners 22b additionally includes a mitered corner fold line 31b disposed in a parallel relationship to the third pair of fold lines which allows the unit to be folded so as to assume the shape of a mitered corner. Contiguous with the side panels 16b are a pair of connecting panels 34b. Each of the connecting panels has a connecting panel fold line 40b which defines the junction between the side panels 16b and the connecting panels 34b. Both of the connecting panels have a pair of connecting panel end flaps 36b which are contiguous with the connecting panels and a pair of connecting panel end flap fold lines 38b which define the junction between the connecting panel 34b and the connecting panel end flaps 36b. At least one of the connecting panels 34b has a pair of adjacent mitered corners 22b**.

Figure 4:
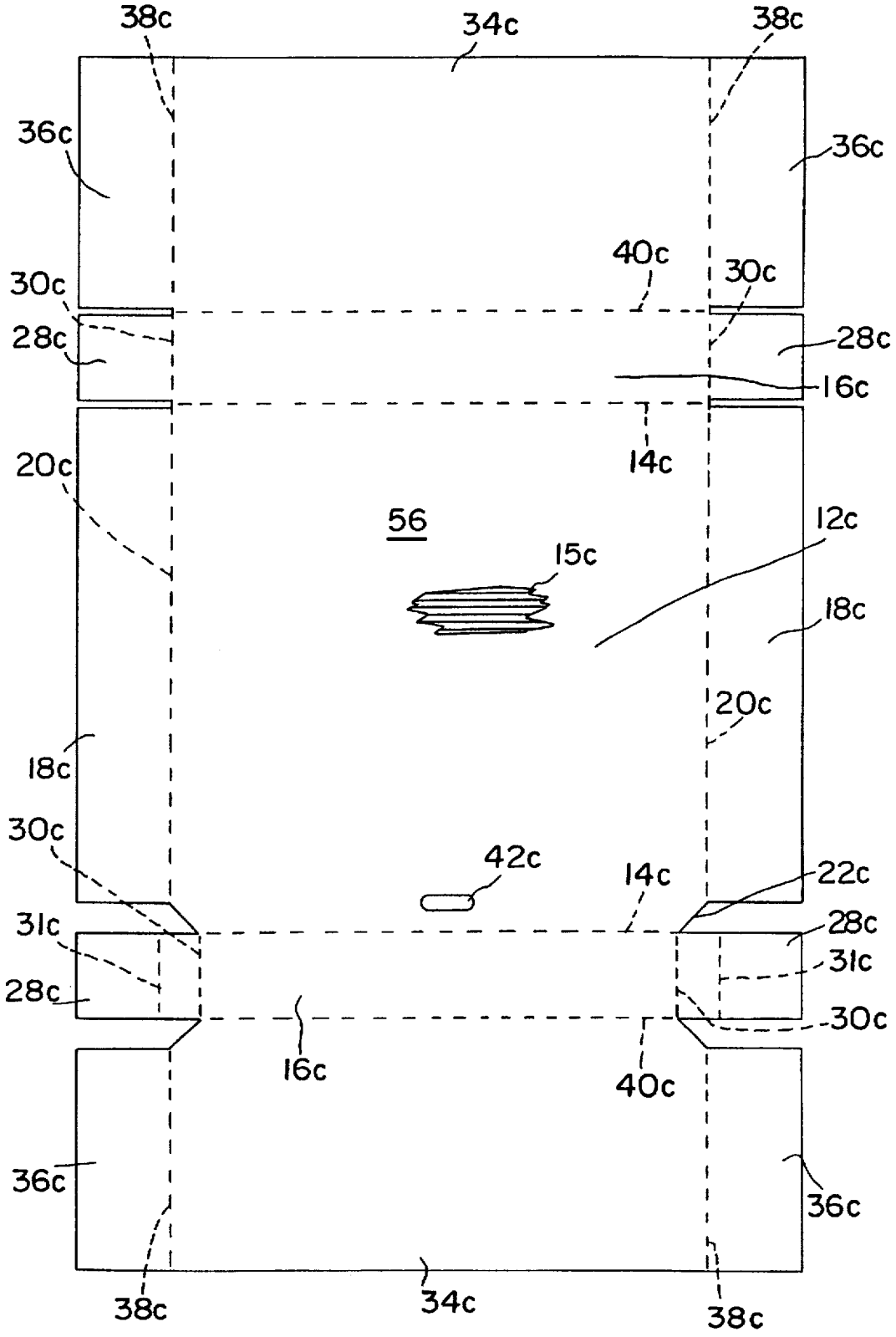
FIG. 4 is an embodiment of the present invention used to construct a king size mattress and box spring. Four of the units are combined to construct a king size mattress or box spring.

Referring to FIG. 4, an embodiment of the present invention used to construct king size beds, is illustrated. Four of the units 56 are used to construct king size mattresses and box springs. A planar support panel 12c is provided with a pair of side panels 16c and a first pair of fold lines 14c which define the junction between the planar support panel and the side panels. The first pair of fold lines 14c are parallel to the direction of the corrugation 15c to provide maximum structural strength for the display bed unit. A pair of end flaps 18c are contiguous with the planar support panel 12c and a second pair of fold lines 20c define the junction between the planar support panel and the end flaps. The planar support panel has at least two adjacent mitered corners 22c and a hand hold 42c. Each of the side panels 16c has a pair of end tabs 28c and a third pair of fold lines 30c which define the junction between a given side panel and its end tabs. The side panel which is adjacent to the mitered corners additionally includes a mitered corner fold line 31c. Contiguous with the side panels 16c are a pair of connecting panels 34c. Each of the connecting panels has a connecting panel fold line 40c which defines the junction between the side panels 16c and the connecting panels 34c. Both of the connecting panels 34c have a pair of connecting panel end flaps 36c which are contiguous with the connecting panels and a pair of connecting panel end flap fold lines 38c which define the junction between the connecting panel 34c and the connecting panel end flaps 36c. At least one of the connecting panels 34c has a pair of adjacent mitered corners 22c.

Figure 5:
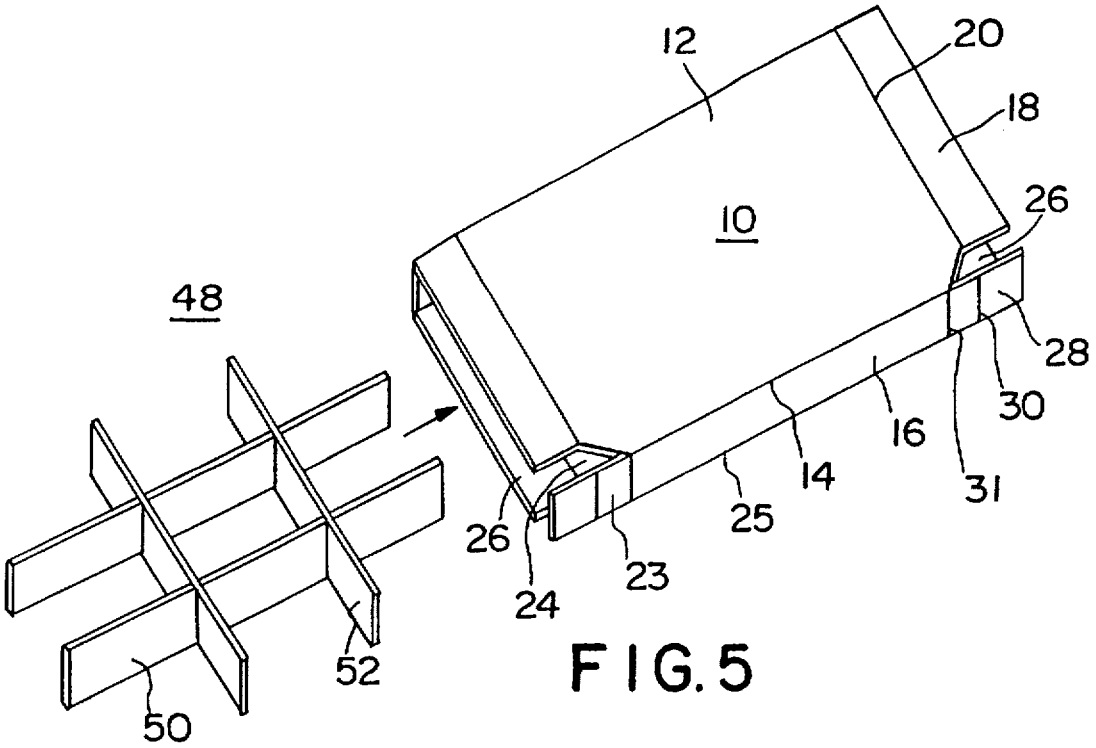
FIG. 5 illustrates one of the display bed units in a partially assembled state and an embodiment of an internal reinforcement member which is placed inside of the cavity in the unit.

Referring now to FIG. 5, a single bed unit of FIG. 1 is illustrated folded partially together. To fold the box into the desired box-like shape, the unitary connecting panel 24 is attached using connecting flap 41 to free edge 25. To facilitate attachment of connecting flap 41 to free edge 25 the planar support panel 12 is folded along the first pair of fold lines 14 such that the side panels 16 are disposed in a substantially perpendicular relationship to both the planar support panel 12 and the unitary connecting panel 24. The open ends of the unit are closed by folding end tabs 28 inwardly along the third pair of fold lines 30 and if present on a given side panel, mitered corner fold lines 31. End flaps 18 are folded along second pair of fold lines 20 and fastened to the second pair of end flaps 26 which are folded along the fourth pair of fold lines 32. Fastening means used to assemble the unit into the desired box-like shape preferably include glue or tape. However, other fastening means may be used if desired.

The preferred embodiment of an internal reinforcement member 48 is illustrated in FIG. 5 with the arrow indicating placement of the internal reinforcement member inside of the unit prior to closing the ends of the unit. In preferred embodiments, the internal reinforcement member is in the form of a lattice framework that is capable of internally reinforcing the unit. The lattice framework embodiment of the internal reinforcement member includes a lengthwise support 50 and a widthwise support 52. If desired, additional lengthwise and widthwise support members may be added to increase the strength of the internal reinforcement member. Applicants have found that internal reinforcements such as the lattice framework embodiment can support up to 700 pounds on a display mattress or box spring. The internal reinforcement member is preferably constructed of heavy-duty corrugated cardboard, however, a variety of other materials may be acceptable for constructing the internal reinforcement member, including but not limited to, plastics, foam materials, and particle board. Internal reinforcement members may assume a variety of shapes other than the lattice framework shape, such as for example, a "zig-zag" shape created by folding a single cardboard panel along a series of vertical fold lines. Alternatively, different types of reinforcement units may be combined. For example, a lattice framework could be combined with a zig-zag unit wherein small zig-zag units are placed within the cells formed by the lattice framework.

Figure 6:
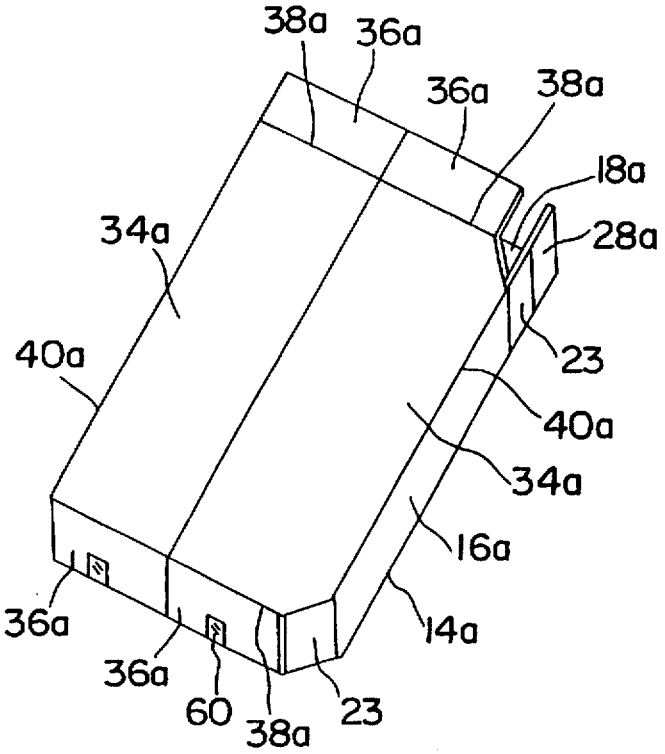
FIG. 6 illustrates one of the display bed units in a partially assembled state wherein the mitered corners of the unit are visible.

Referring now to FIG. 6, a generic representation of the display bed unit types illustrated in FIGS. 2, 3 or 4 is presented in partially constructed form. For the sake of clarity, the numbered parts of the display bed unit illustrated in FIG. 2 will be utilized to demonstrate how the units are folded into the desired final shape. However, it should be understood that the corresponding parts of the embodiments illustrated in FIGS. 3 and 4 could be used also to designate the partially constructed unit in FIG. 6. To construct the unit, the connecting panels 34a are fastened along their free edge to one another by folding along connecting panel fold line 40a such that side panels 16a are substantially perpendicular to the connecting panels 34a. To bring the free edges of the connecting panels together, it is also necessary to fold along the first pair of fold lines 14a such that the side panels 16a are substantially perpendicular to the planar support panel 12a. End tabs 28a are folded towards the inside of the box by folding along fold lines 30a and for the mitered corners, along mitered corner fold lines 31a to provide mitered corner panel 23. End flaps 18a are folded along the second pair of fold lines 20a. Connecting panel end flaps 36a are folded along connecting panel end flap fold lines 38a and secured by fastening means, such as tape 60.

Figure 7A:
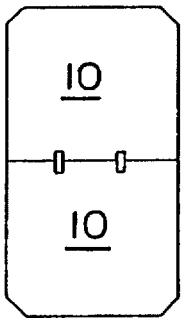
FIGS. 7*a, b, c* and *d* illustrate how the individual display bed units of FIGS. 1, 2, 3 and 4 are combined to form the different size display beds.

Referring now to FIG. 7a, two of the display bed units 10 presented in FIG. 1 have been constructed and combined to form a single size mattress or box spring.

Figure 7B:
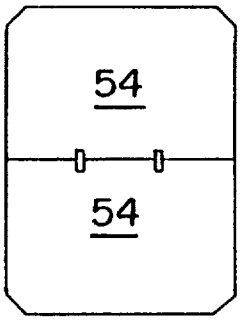

FIG. 7b represents two of the display bed units 54 presented in FIG. 2 which have been constructed and combined to form a full size mattress or box spring.

Figure 7C:
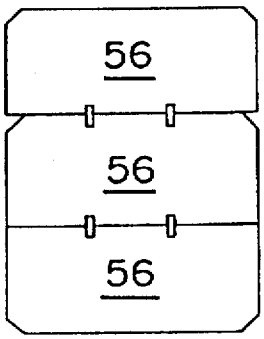

FIG. 7c represents three of the display bed units 56 illustrated in FIG. 3 combined to form a queen size mattress or box spring.

Figure 7D:
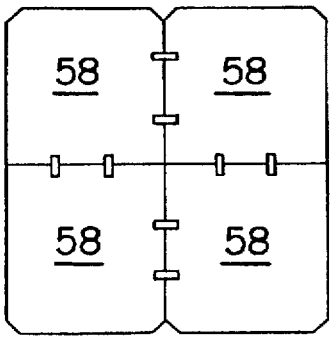

FIG. 7d illustrates four of the display bed units 58 illustrated in FIG. 4 which have been constructed and combined to form a king size mattress or box spring.

Figure 8:
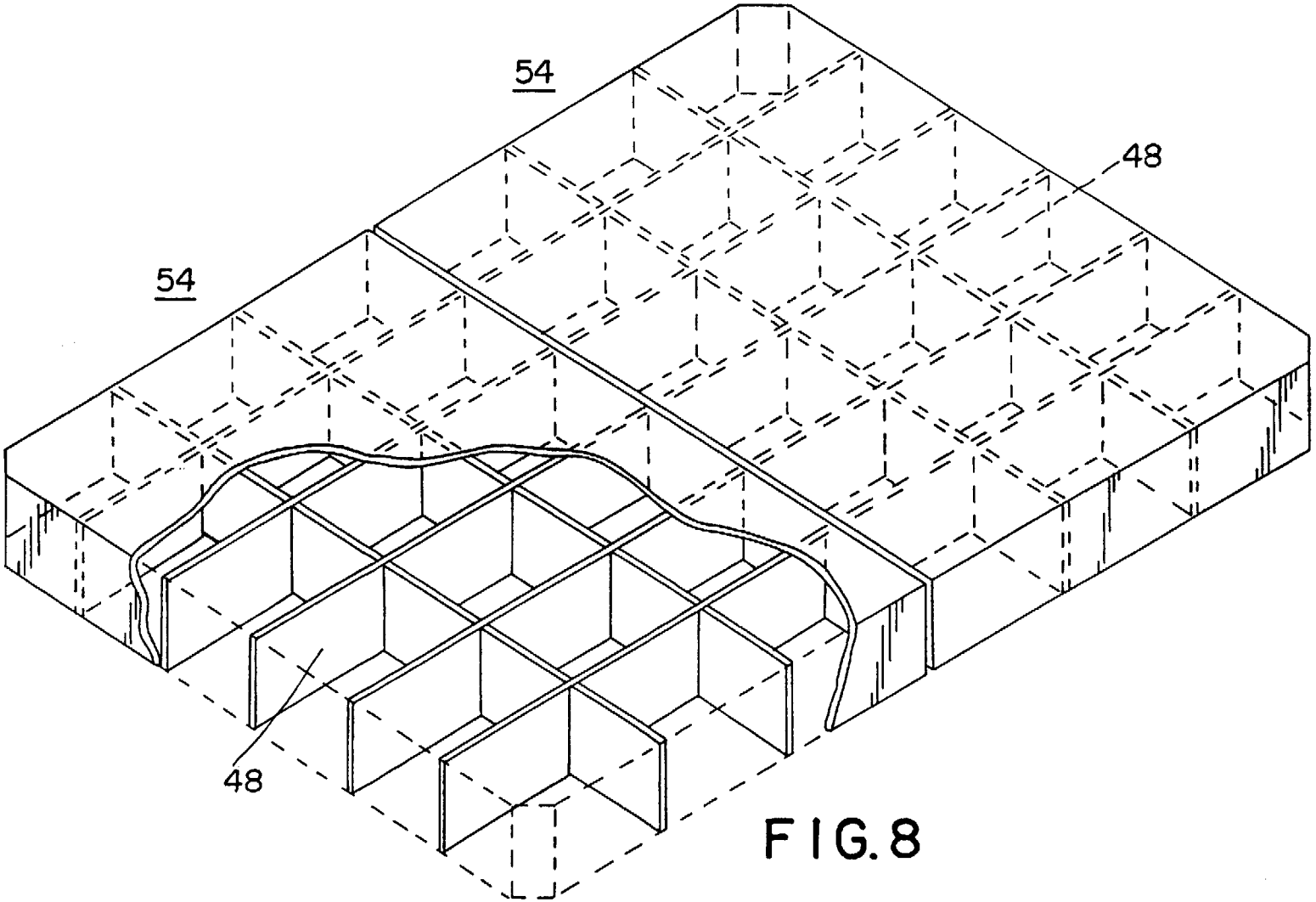
FIG. 8 is a partial cut-away view of a full size display bed illustrating the position of an internal reinforcement member positioned inside the display bed unit.

Referring now to FIG. 8, the full size bed illustrated in FIG. 7b is presented in a cut-away view wherein internal reinforcement members 48 of the lattice framework type are illustrated inside of the display bed units 54. The figure additionally illustrates how the mitered corners provide a more accurate representation of the rounded corners found on most mattresses and box springs.

We claim:

1. A display bed unit comprising a board blank having corrugations and having at least one planar support panel having a first pair of fold lines and a pair of side panels wherein said side panels are contiguous with said planar support panel and said first pair of fold lines define a junction between said planar support panel and said side panels wherein said corrugations in said board blank run parallel to said first pair of fold lines, said planar support panel also including a pair of end flaps which are contiguous with said planar support panel and a second set of fold lines which define a junction between said planar support panel and said end flaps, said planar support panel having at least two adjacent mitered corners said planar support member having a hand-hold disposed proximal to and equidistant from said adjacent mitered corners, each of said side panels having one pair of end tabs which are contiguous with said side panels and a third pair of fold lines which define a junction between said end tabs and said side panels, said third pair of fold lines disposed substantially perpendicular to said first pair of fold lines, said side panels having a pair of mitered corner fold lines disposed in a parallel relationship to said third pair of fold lines.

2. A display bed unit according to claim 1 wherein said display bed unit has a unitary connecting panel which is contiguous with one of said side panels, the other of said pair of side panels having a free edge, said unitary connecting panel including a second pair of end flaps which are contiguous with said connecting panel and a fourth pair of fold lines which define a junction between said connecting panel and said second pair of end flaps, said connecting panels having at least two adjacent mitered corners and a connecting flap opposite said adjacent mitered corners.

3. A display bed unit according to claim 1 wherein said display bed unit has a pair of connecting panels, each of which is contiguous with one of said side panels, each of said connecting panels having a free edge, said connecting panels having a connecting panel fold line which defines the junction between said side panels and said connecting panels, both of said connecting panels having a pair of connecting panel end flaps which are contiguous with said connecting panels and a pair of connecting panel end flap fold lines which define the junction between said connecting panel and said connecting panel end flaps, wherein at least one of said connecting panels has at least two adjacent mitered corners.

4. A display bed unit according to claim 1 wherein a plurality of said units are used to assemble a display mattress.

5. A display bed unit according to claim 1 wherein a plurality of said units are used to assemble a display box-spring.

6. A display bed unit according to claim 1 wherein a plurality of said units are combined to form a king-sized mattress.

7. A display bed unit according to claim 1 wherein a plurality of said units are combined to form a queen-sized mattress.

8. A display bed unit according to claim 1 wherein a plurality of said units are combined to form a full-sized mattress.

9. A display bed unit according to claim 1 wherein a plurality of said units are combined to form a single-sized mattress.

10. The display bed unit of claim 2 wherein said connecting flap of said unitary connecting panel is attached by fastening means to said free edge, said second pair of end flaps are folded along said fourth pair of fold lines and attached to one another by fastening means, said end flaps are folded along said second pair of fold lines and attached to one another by fastening means, said end tabs proximal to said mitered corners are folded along both said mitered corner fold lines and said third set of fold lines and said end tabs proximal to said free edge are folded along said third pair of fold lines, said end tabs are attached to said end flaps by fastening means and said planar support panel is folded along said first pair of fold lines such that said side panels are disposed in a substantially perpendicular relationship to said planar support surface.

11. The display bed unit of claim 3 wherein said free edges of said pair of connecting panels are attached by fastening means, said connecting panel end flaps are folded along said connecting panel end flap fold lines and said connecting panel end flaps are attached to one another by fastening means, said end flaps are folded along said second pair of fold lines and attached to one another by fastening means, said end tabs proximal to said mitered corners are folded along both said mitered corner fold lines and said third set of fold lines and said end tabs distal from said mitered corner are folded along said third pair of fold lines, said end tabs are attached to said end flaps by fastening means and said planar support panel is folded along said first pair of fold lines such that said side panels are disposed in a substantially perpendicular relationship to said planar support surface.

12. The display bed unit of claim 4 wherein said display bed units include an internal reinforcement member.

13. The display bed unit of claim 5 wherein said display bed units include an internal reinforcement member.

14. The display bed unit of claim 12 including an internal reinforcement member comprising at least one lengthwise corrugated board member and at least one widthwise corrugated board member wherein said lengthwise corrugated board member is disposed substantially perpendicular relative to said widthwise corrugated board member thereby defining a lattice framework capable of internally reinforcing said display bed unit.

15. The display bed unit of claim 13 wherein said internal reinforcement member comprises a corrugated board member having a longitudinal axis and having fold lines disposed perpendicularly to said longitudinal axis and wherein said corrugated board is folded along said fold lines into a substantially zig-zag conformation.

16. A method for constructing a corrugated board display bed comprising the steps of:

providing a planar support panel having corrugations and having a first pair of fold lines and a pair of side panels wherein said side panels are contiguous with said planar support panel and said first pair of fold lines define a junction between said planar support panel and said side panels wherein said corrugations in said planar support panel run parallel to said first pair of fold lines, said planar support panel also including a pair of end flaps which are contiguous with said planar support panel and a second set of fold lines which define a junction between said planar support panel and said end flaps, said planar support panel having at least two adjacent mitered corners, each of said side panels having one pair of end tabs which are contiguous with said side panels and a third pair of fold lines which define a junction between said end tabs and said side panels, said third pair of fold lines disposed substantially perpendicular to said first pair of fold lines, said side panels having a pair of mitered corner fold lines disposed in a parallel relationship to said third pair of fold lines, folding said planar support panel along said first pair of fold lines such that said side panels are disposed substantially perpendicularly to said planar support panel, folding said end flaps along said second set of fold lines such that said end flaps are disposed substantially perpendicularly to said planar support panel, folding said end tabs along said third pair of fold lines and folding said end tabs along said mitered corner fold lines such that said end tabs are perpendicular to said planar support panel; and providing at least one of said display bed units in folded form to construct a display mattress or box spring having the dimensions of a desired bed size.

17. A display bed unit comprising a board blank having corrugations and having at least one planar support panel having a first pair of fold lines and a pair of side panels wherein said side panels are contiguous with said planar support panel and said first pair of fold lines define a junction between said planar support panel and said side panels wherein said corrugations in said board blank run parallel to said first pair of fold lines, said planar support panel also including a pair of end flaps which are contiguous with said planar support panel and a second set of fold lines which define a junction between said planar support panel and said end flaps, said planar support panel having at least two adjacent mitered corners, each of said side panels having one pair of end tabs which are contiguous with said side panels and a third pair of fold lines which define a junction between said end tabs and said side panels, said third pair of fold lines disposed substantially perpendicular to said first pair of fold lines, said side panels having a pair of mitered corner fold lines disposed in a parallel relationship to said third pair of fold lines, said display bed unit having a pair of connecting panels, each of which is contiguous with one of said side panels, each of said connecting panels having a free edge, said connecting panels having a connecting panel fold line which defines a junction between said side panels and said connecting panels, both of said connecting panels having a pair of connecting panel end flaps which are contiguous with said connecting panels and a pair of connecting panel end flap fold lines which define a junction between said connecting panel and said connecting panel end flaps, wherein at least one of said connecting panels has at least two adjacent mitered corners.

18. A display bed unit comprising a board blank having corrugations and having at least one planar support panel having a first pair of fold lines and a pair of side panels wherein said side panels are contiguous with said planar support panel and said first pair of fold lines define a junction between said planar support panel and said side panels wherein said corrugations in said board blank run parallel to said first pair of fold lines, said planar support panel also including a pair of end flaps which are contiguous with said planar support panel and a second set of fold lines which define a junction between said planar support panel and said end flaps, said planar support panel having at least two adjacent mitered corners each of said side panels having one pair of end tabs which are contiguous with said side panels and a third pair of fold lines which define a junction between said end tabs and said side panels, said third pair of fold lines disposed substantially perpendicular to said first pair of fold lines, said side panels having a pair of mitered corner fold lines disposed in a parallel relationship to said third pair of fold lines, said display bed unit having a unitary connecting panel which is contiguous with one of said side panels, the other of said pair of side panels having a free edge, said unitary connecting panel including a second pair of end flaps which are contiguous with said connecting panel and a fourth pair of fold lines which define a junction between said connecting panel and said second pair of end flaps, said connecting panels having at least two adjacent mitered corners and a connecting flap opposite said adjacent mitered corners.

19. A display bed unit comprising a paperboard blank having at least one planar support panel having a first pair of fold lines and a pair of side panels wherein said side panels are contiguous with said planar support panel and said first pair of fold lines define a junction between said planar support panel, said planar support panel also including a pair of end flaps which are contiguous with said planar support panel and a second set of fold lines which define a junction between said planar support panel and said end flaps, said planar support panel having at least two adjacent mitered corners said planar support member having a hand-hold disposed proximal to and equidistant from said adjacent mitered corners, each of said side panels having one pair of end tabs which are contiguous with said side panels and a third pair of fold lines which define a junction between said end tabs and said side panels, said third pair of fold lines disposed substantially perpendicular to said first pair of fold lines, said side panels having a pair of mitered corner fold lines disposed in a parallel relationship to said third pair of fold lines.

20. A display bed according to claim 1 wherein a plurality of said units are combined to form a rigid sleeping surface.

* * * * *